United States Patent [19]

Spillers

[11] 4,046,362

[45] Sept. 6, 1977

[54] BOARD HOLDING DEVICE

[76] Inventor: Milton L. Spillers, 310 S. River St., Newberg, Oreg. 97132

[21] Appl. No.: 702,706

[22] Filed: July 6, 1976

[51] Int. Cl.[2] ..... B25B 1/20

[52] U.S. Cl. ..... 269/43; 24/243 R; 24/263 R

[58] Field of Search ..... 24/243 T, 263 T; 248/226 A; 269/43, 249

[56] References Cited

U.S. PATENT DOCUMENTS

| | | | |
|---|---|---|---|
| 977,835 | 12/1910 | Piscator | 248/226 A |
| 1,508,882 | 9/1924 | Hosmer | 24/263 DT |
| 2,510,596 | 6/1950 | Murphy | 24/263 A |
| 2,993,254 | 7/1961 | Larson | 24/263 A |
| 3,170,708 | 2/1965 | Miller | 24/263 A |
| 3,443,831 | 5/1969 | Grange | 24/263 A |
| D. 199,957 | 1/1965 | Bertokle | 248/226 A |

*Primary Examiner*—Peter M. Caun

[57] ABSTRACT

This device is for use in the martial arts such as karate. The device consists primarily of a pair of units with handle grip means and clamp means for rendering a multiple number of wooden boards stationary, so as to be broken simultaneously.

1 Claim, 2 Drawing Figures

14
10
13
19
12
15
11
17
18
16
19
19
18
16
15
17
11
13
12
14

14
10
11
19
11
14

BOARD HOLDING DEVICE

This invention relates to clamping devices, and more particularly to a board holding device.

It is, therefore, the principal object of this invention to provide a board holding device, which will be used in the martial arts.

Another object of this invention is to provide a board holding device, which will clampingly engage a plurality of wood boards. It is very difficult to hold more than one board by hand, while a person breaks them, either by hand or foot, and the present invention serves to keep the boards at the same level and pressure at all times, which will insure a more accurate break thereof.

A further object of this invention is to provide a device, of the type described, which will be provided with handle grip means for holding the frame, which forms clamp means for the boards.

Other objects of the invention are to provide a board holding device, which is simple in design inexpensive to manufacture, rugged in construction, easy to use and efficient in use.

These and other objects will be readily evident upon a study of the following specification, and the accompanying drawing, wherein.

Figure 1:
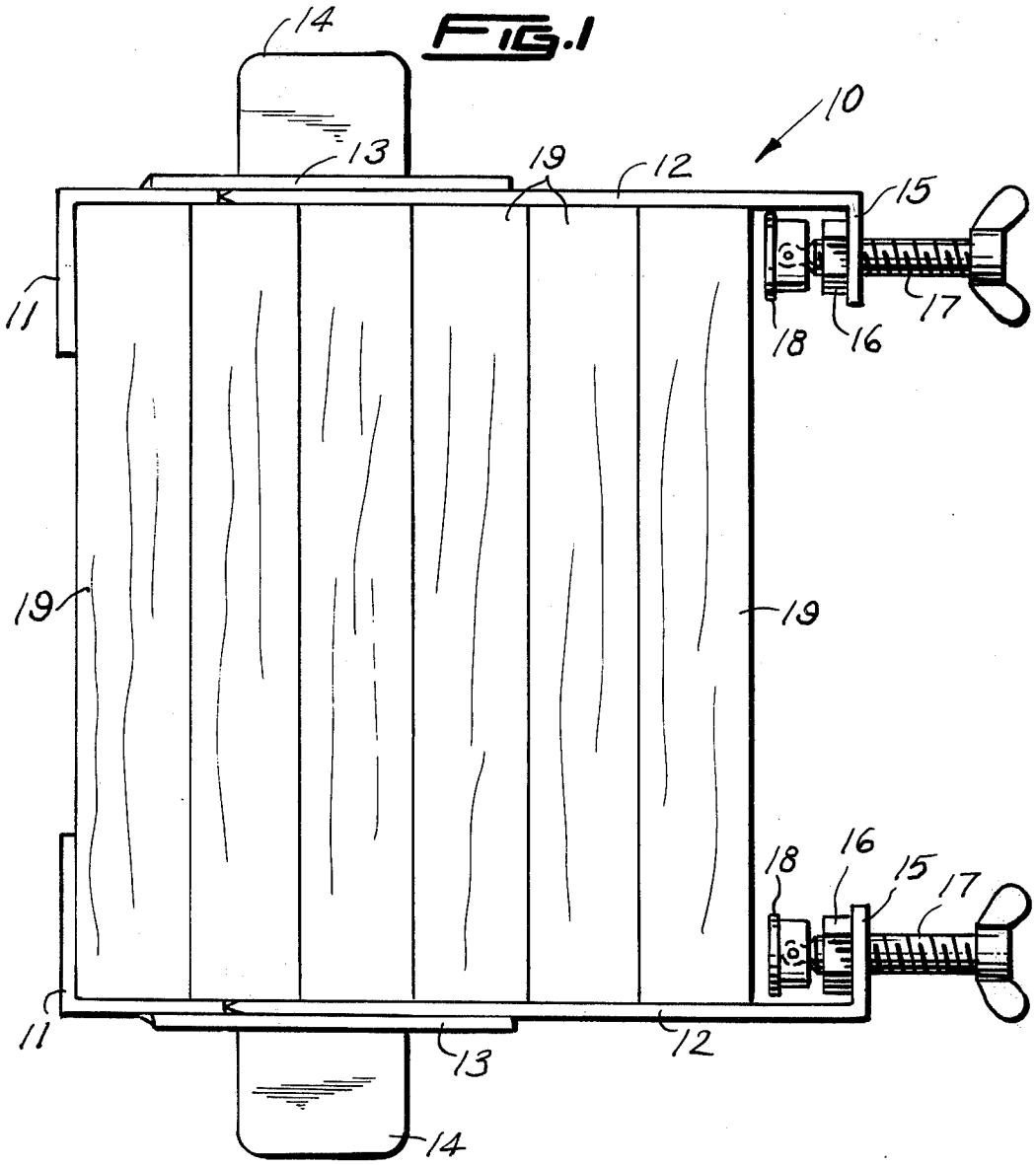
FIG. 1 is a side view of the present invention, shown in elevation.
Figure 2:
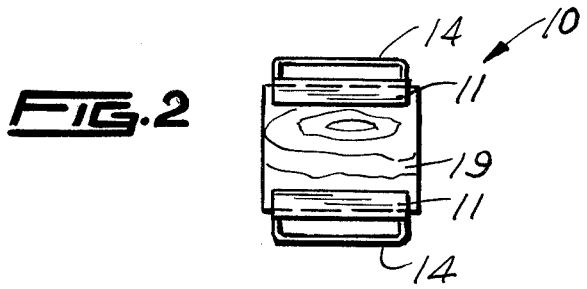
FIG. 2 is a front view of FIG. 1, shown on a smaller scale.

According to this invention, a board holding device 10 is shown to include a pair of angle irons 11, one leg of which abuts with, and is welded to, an L-shaped plate 12, the combination of members 11 and 12 being welded together by an overlapping plate 13, to which is fixedly secured, by welding or other means, a handle grip 14. The narrow panel 15 portion of plate 12 has welded thereto, a nut fastener 16, which threadably receives bolt 17, having a pivotable end portion 18, which abuts with, and urges, a plurality of stacked boards 19 towards a leg portion of the angle irons 11.

When device 10 is used, the boards 19 are rendered stationary by means of the bolts 17, and device 10 is manually held by the handle grip means, so as to enable a person to break the boards 19 by hand or foot means.

While various changes may be made in the detail construction, it is understood that such changes will be within the spirit and scope of the present invention as is defined by the appended claims.

What I claim is:

1. A board holding device, comprising in combination, a pair of clamp units secured around opposite ends of a plurality of same-length boards stacked in a row with flat sides thereof abutting each other; each of said clamp units being comprised of an angle iron having a pair of legs at right angles to each other, an L-shaped plate comprised of a wide panel and a narrow panel at right angles to each other, and end edge of said plate wide panel abutting an end edge of one of said angle iron legs and being secured thereto, one flat side of said plate wide panel and one flat side of said angle iron leg abutting said board ends, an overlapping plate having one flat side abutting an opposite flat side of said L-shaped plate wide panel and an opposite flat side of said angle iron leg and being welded thereto, said overlapping plate bridging said welded, abutting end edges of said plate wide panel and said angle iron leg, an opposite side of said overlapping plate having a U-shaped handle grip welded thereto; said narrow panel of said L-shaped plate having a nut fastener welded thereto, an opening of said nut fastener being aligned with an opening through said narrow panel, a bolt extending through said narrow panel opening being threadingly engaged in said nut fastener, the other of said angle iron legs abutting with one endmost of said plurality of boards, while a pivotable portion on an end of said bolt abuts an opposite endmost of said plurality of boards when a winged head upon an opposite end of said bolt is manually turned.

* * * * *